US009080456B2

(12) United States Patent
Harris, Jr. et al.

(10) Patent No.: US 9,080,456 B2
(45) Date of Patent: Jul. 14, 2015

(54) NEAR FLOW PATH SEAL WITH AXIALLY FLEXIBLE ARMS

(75) Inventors: John Wesley Harris, Jr., Greenville, SC (US); Bruce J. Badding, Greenville, SC (US); Brian D. Potter, Greenville, SC (US)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 13/354,365

(22) Filed: Jan. 20, 2012

(65) Prior Publication Data

US 2013/0187339 A1 Jul. 25, 2013

(51) Int. Cl.
*F01D 5/02* (2006.01)
*F01D 11/00* (2006.01)

(52) U.S. Cl.
CPC ..... *F01D 11/00* (2013.01); *F01D 11/001* (2013.01); *F01D 11/008* (2013.01); *F05D 2220/3213* (2013.01)

(58) Field of Classification Search
CPC ..... F01D 11/00; F01D 11/001; F01D 11/02; F01D 11/008
USPC ..... 277/409, 411, 412, 414, 421; 415/115, 415/173.4, 173.7, 174.4
See application file for complete search history.

(56) References Cited

U.S. PATENT DOCUMENTS

| | | | | |
|---|---|---|---|---|
| 4,309,147 | A * | 1/1982 | Koster et al. | 416/95 |
| 5,816,776 | A * | 10/1998 | Chambon et al. | 415/174.5 |
| 5,833,244 | A | 11/1998 | Salt et al. | |
| 6,464,453 | B2 | 10/2002 | Toborg et al. | |
| 7,252,481 | B2 | 8/2007 | Stone | |
| 7,410,345 | B2 | 8/2008 | Bracken | |
| 7,488,153 | B2 | 2/2009 | Reigl | |
| 2005/0129525 | A1 | 6/2005 | Bekrenev et al. | |
| 2008/0008582 | A1 | 1/2008 | Pickens et al. | |
| 2008/0050233 | A1 | 2/2008 | Steiger et al. | |
| 2008/0112793 | A1 | 5/2008 | Lee et al. | |
| 2010/0178160 | A1 | 7/2010 | Liotta et al. | |
| 2010/0196164 | A1 | 8/2010 | Liotta et al. | |
| 2010/0232938 | A1 | 9/2010 | Harris, Jr. et al. | |
| 2010/0232939 | A1 | 9/2010 | Piersall et al. | |
| 2010/0254805 | A1 | 10/2010 | Garcia-Crespo et al. | |
| 2011/0163506 | A1 | 7/2011 | Hafner | |

FOREIGN PATENT DOCUMENTS

| | | | |
|---|---|---|---|
| EP | 1512841 | A2 | 3/2005 |
| EP | 2218879 | A2 | 8/2010 |
| EP | 2360352 | A2 | 8/2011 |
| EP | 2365235 | A1 | 9/2011 |

OTHER PUBLICATIONS

U.S. Appl. No. 12/902,561, filed Oct. 12, 2010, Farrell, et al.
U.S. Appl. No. 12/829,632, filed Jul. 2, 2010, Farrell, et al.
Search Report from EP Application No. 13151610.6 dated Sep. 13, 2013.

* cited by examiner

*Primary Examiner* — Gilbert Lee
(74) *Attorney, Agent, or Firm* — Sutherland Asbill & Brennan LLP

(57) ABSTRACT

The present application provides a near flow path seal for a gas turbine. The near flow path seal includes a base, a pair of arms extending from the base, and a curved indentation positioned between the pair of arms.

20 Claims, 3 Drawing Sheets

NEAR FLOW PATH SEAL WITH AXIALLY FLEXIBLE ARMS

TECHNICAL FIELD

The present application and the resultant patent relate generally to gas turbine engines and more particularly relate to a near flow path seal with axially flexible arms.

BACKGROUND OF THE INVENTION

Generally described, a gas turbine includes a main flow path intended to confine a main working fluid therein, i.e., the hot combustion gases. Adjacent turbine rotor structural components may be provided with a cooling fluid therein that is independent of the main working fluid. Sealing device thus may be used to shield the rotor components from direct exposure to the main working fluid driving the turbine. Such sealing devices also prevent the cooling fluid from escaping with the main working fluid. Typical sealing devices, however, may reduce the efficiency and performance of the turbine due to leakage. For example, leakage in sealing devices such as inter-stage seals may require an increase in the amount of parasitic fluid needed for cooling purposes. The use of the parasitic cooling fluid decreases the overall performance and efficiency of the gas turbine engine.

There is thus a desire for an improved turbine flow path seal, particularly for use in-between stages. Preferably such a flow path seal may effectively shield rotor components with reduced leakage and without sacrificing overall gas turbine engine efficiency and output.

SUMMARY OF THE INVENTION

The present application and the resultant patent thus provide a near flow path seal for use in a gas turbine engine. The near flow path seal includes a base, a pair of arms extending from the base, and a curved indentation positioned between the pair of arms.

The present application and the resultant patent further provide a near flow path seal for a gas turbine. The near flow path seal may include a separated base, a pair of arms extending from the separated base in a fork-like configuration, and a curved indentation positioned between the pair of arms.

The present application and the resultant patent further provide a near flow path seal for a gas turbine. The near flow path seal may include a base, a pair of arms extending from the base in a parallel orientation with the first arm being higher than the second arm, and a curved indentation positioned between the pair of arms.

These and other features and improvements of the present application and the resultant patent wilt become apparent to one of ordinary skill in the art upon review of the following detailed description when taken in conjunction with the several drawings and the appended claims.

DETAILED DESCRIPTION

Figure 1:
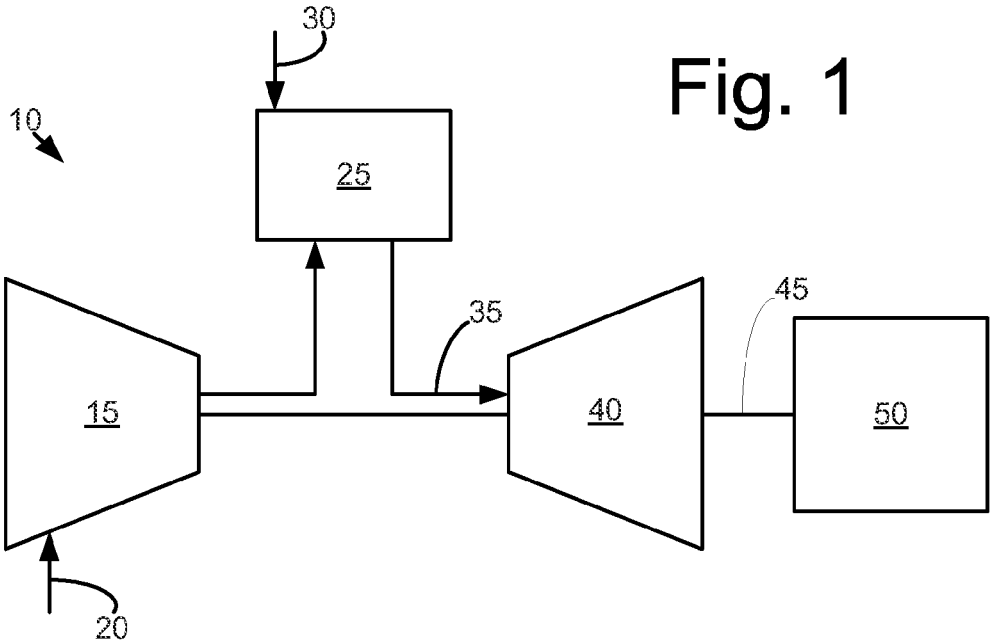
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
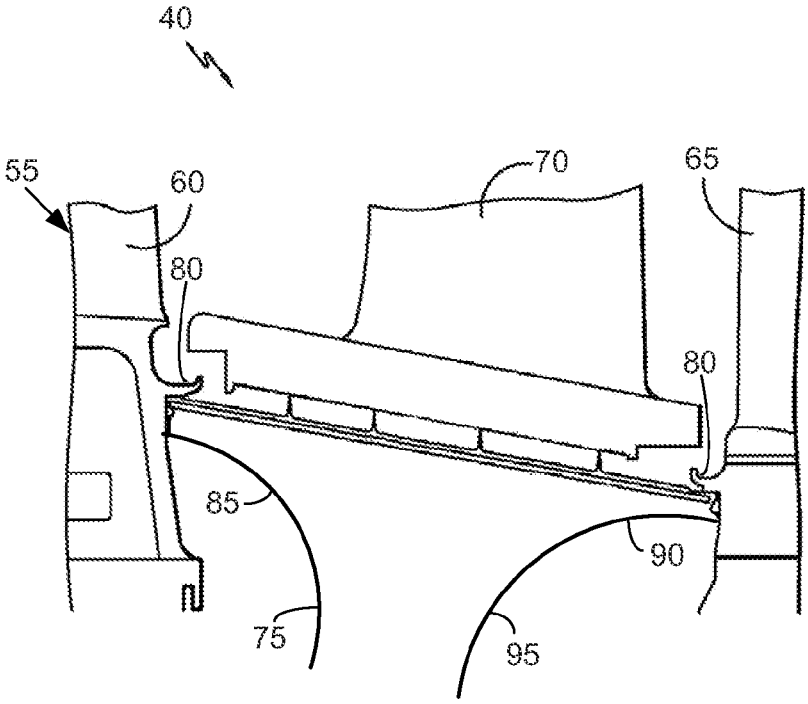
FIG. 2 is a side view of a portion of a turbine with a known near flow path seal.

FIG. 2 shows an example of the turbine 40 with portions of a number of stages 55. Specifically, a first bucket 60 and a second bucket 65 are shown with a nozzle 70 therebetween. The buckets 60, 65 may be attached to the shaft 45 for rotation therewith. An inter-stage or a near flow path seal 75 may be positioned about the nozzle 70 and in-between the buckets 60, 65. The near flow path seal 75 may extend from an axial protrusion 80 on each of the buckets 60, 65. The near flow path seal 75 may form an outer boundary for the flow of combustion gases 35 so as to prevent the flow of combustion gases 35 from migrating therethrough.

Generally described, the near flow path seal 75 may include a pair of arms: a first arm 85 and a second arm 90. The arms 85, 90 may extend from a seal base 95. The arms 85, 90 and the seal base 95 may form a substantially "T" shaped configuration. This T-shaped configuration may be very stiff in the axial direction (i.e., the direction of the shaft 45) with correspondingly high axial spring rates.

Generally described, the arms 85, 90 of the near flow path seal 75 may deflect outwardly due to centrifugal force and contact the buckets 60, 65 to provide sealing. The near flow path seal 75 also may be subject to axial loading due to rotor gravity sag. This rotor gravity sag loading may be resisted by the friction loading about the bucket 60, 65. The near flow path seal 75 thus may be intended to "stick" to the buckets 60, 65 by generating more friction loading than that induced by rotor gravity sag loading. In addition to the steady loading conditions generated by centrifugal force, resisting such rotor gravity sag loading also may induce an alternating load condition on the arms 85, 90 of the near flow path seal 75. As such, this T-shaped configuration may be relatively stiff and may require substantial mass to accommodate these conflicting forces.

Figure 3:
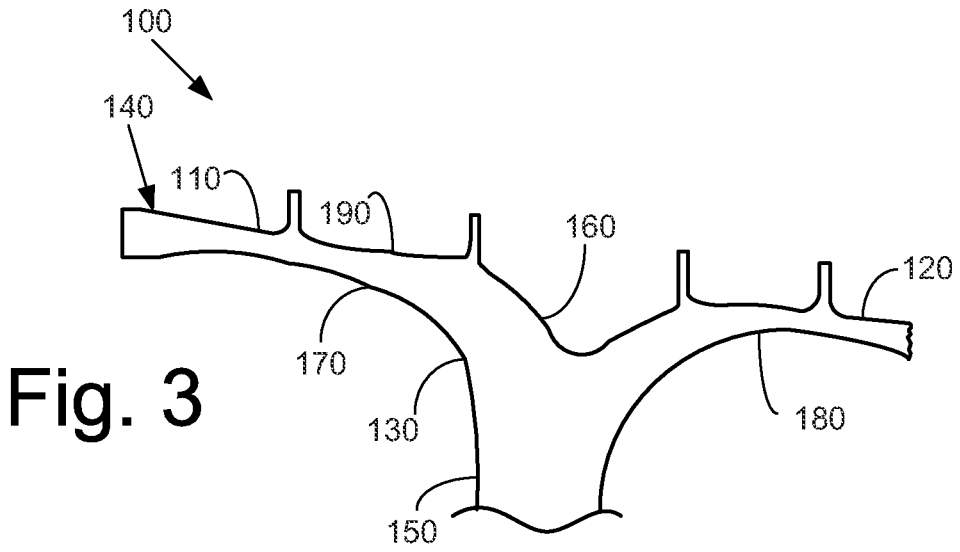
FIG. 3 is a side plan view of a near flow path seal as may be described herein.

FIG. 3 shows an example of a near flow path seal 100 as may be described herein. The near flow path seal 100 includes a pair of arms: a first air 110 and a second arm 120. The near flow path seal 100 also includes a seal base 130 with an arm 110, 120 on either side. Instead of the T-shaped configuration described above, the near flow path seal 100 may include a "gull wing" configuration 140. The gull wing configuration 140 may include an offset base 150, i.e., the first arm 110 may be longer than the second arm 120. The gull wing configuration 140 also may include a curved indentation 160 between the first arm 110 and the second arm 120. The curved indentation 160 may extend into the base 130. The first arm 110 may have a first thickness 170 while the second arm 120 may have a second thickness 180 with the first thickness 170 being larger than the second thickness 180, particularly near the base 130. The first and the second arms 110, 120 may have a somewhat angled configuration 190 with respect to the base 130 with the end of the first arm 110 being higher than the second arm 120 (or vice versa). The gull wing configuration 140 may have an axial stiffness in terms of pounds per inch that may be about half of that of the T-shaped configuration described above. Other components and other configurations may be used herein.

Figure 4:
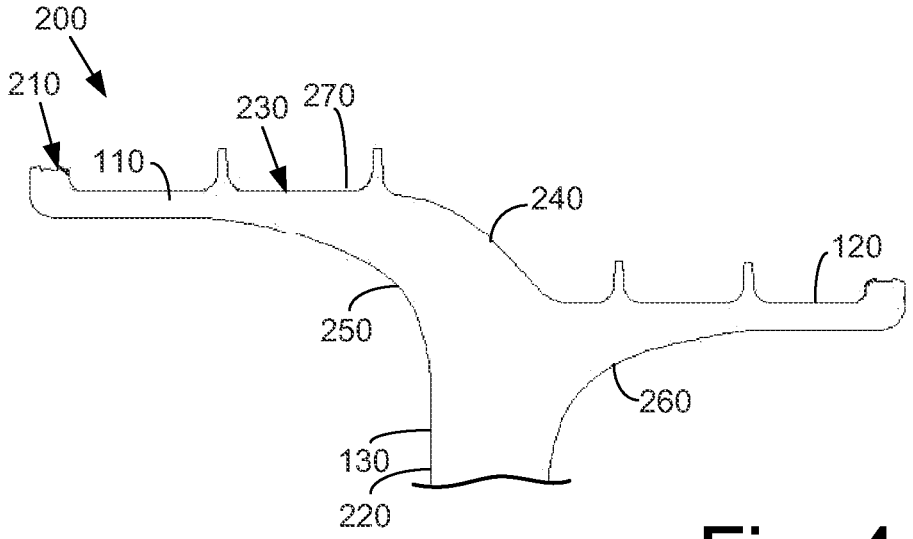
FIG. 4 is a side plan view of an alternative embodiment of a near flow path seal as may be described herein.

FIG. 4 shows an alternative embodiment of a near flow path seal 200 as may be described herein. The near flow path seal 200 also includes the first arm 110, the second arm 120, and the base 130. In this example, the near flow path seal 200 may include a largely "cylindrical" configuration 210. The cylindrical configuration 210 also includes an offset base 220, i.e., the first arm 110 may be longer than the second arm 120. The cylindrical configuration 210 also may include a pair offset arms 230, i.e., the first arm 110 may be positioned above the second arm 120 (or vice versa) with a curved indentation 240 positioned therebetween about the base 130. The first arm 110 may have a first thickness 250 and the second arm 120 may have a second thickness 260 with the first thickness 250 being larger than the second thickness 260, particularly about the curved decline 240. The first arm 110 and the second arm 120 may have a largely parallel configuration 270 with arms 110, 120 extending in largely parallel but opposite directions to each other. The axial stiffness of the cylindrical configuration 210 in terms of pounds per inch may be about a quarter of the axial stiffness of the T-shaped configuration described above. Other components and other configurations may be used herein.

Figure 5:
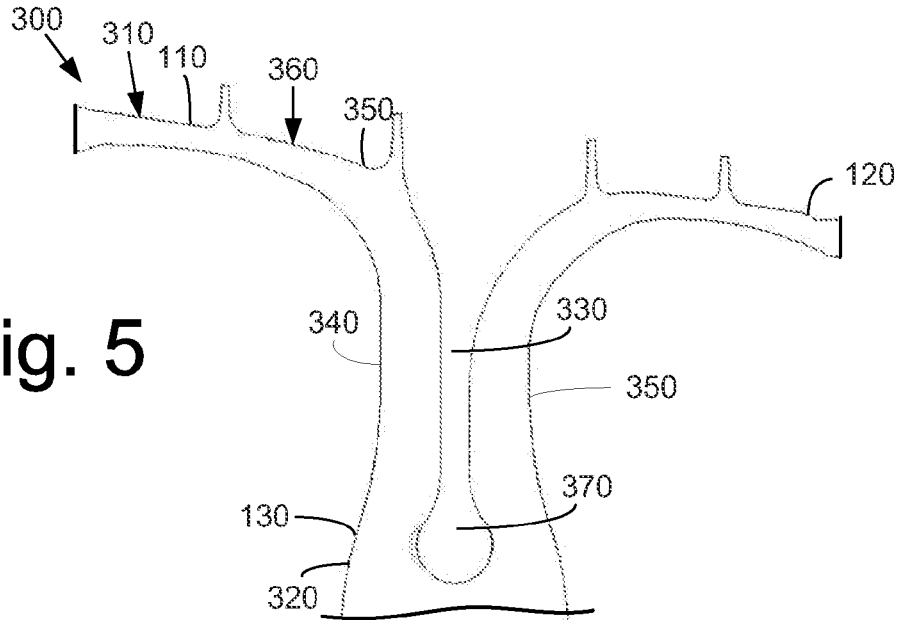
FIG. 5 is a side plan view of an alternative embodiment of a near flow path seal as may be described herein.
Figure 6:
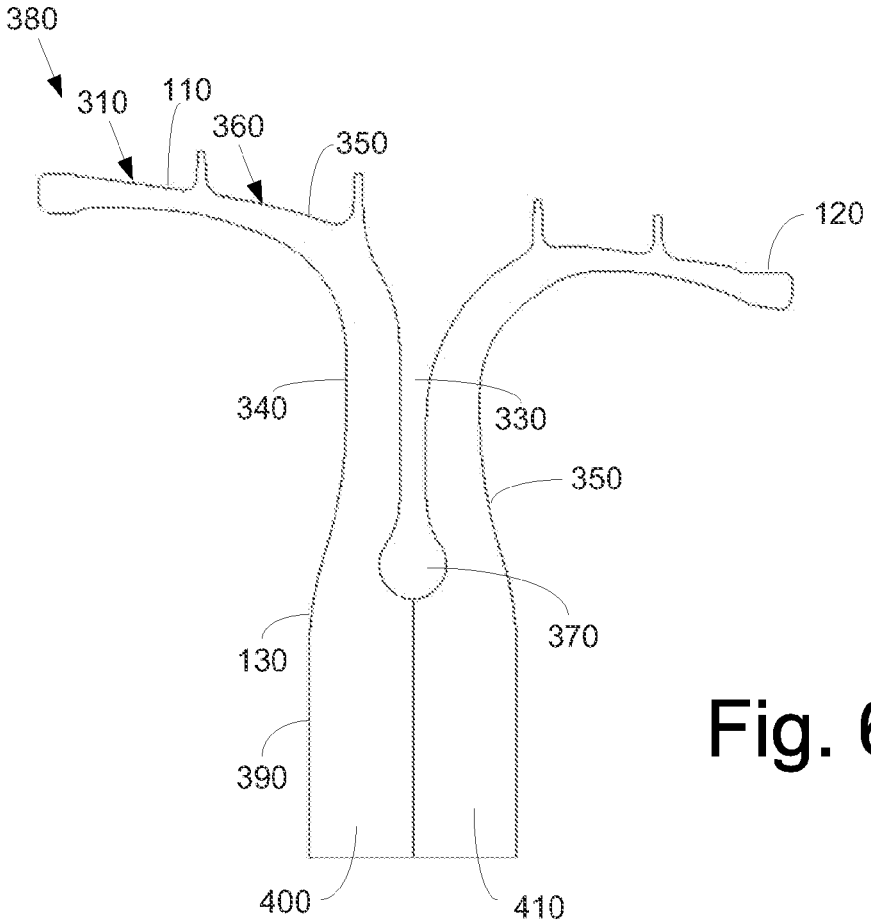
FIG. 6 is a side plan view of an alternative embodiment of a near flow path seal as may be described herein.

FIG. 5 shows a further alternative embodiment of a near flow path seal 300 as may be described herein. The near flow path seal 300 may include the first arm 110, the second arm 120, and the base 130. In this example, the near flow path seal 300 may include a largely "fork-like" configuration 310. The fork-like configuration 310 may include a separated base 320 with a curved indentation 330 extending deeply therein. The effect of the fork-like configuration is a first fork arm 340 and a second fork arm 350 with substantially opposite semi-circular configurations when viewed from the far tips of the arms 340, 350 down through the curved indentation 330 of the separated base 320. The first and second arms 340, 350 also may have an angled configuration 360 with the end of the first arm 340 being higher than that of the second arm 350 (or vice versa). The curved indentation 330 may extend into a semi-circular joint 370. The axial stiffness of the fork configuration 310 may be as low as a few percentage points of the T-shaped configuration described above. Other components and other configurations may be used herein.

As an alternative, a split flow path seal 380 also may be used. The split flow path seal 380 may be similar to the near flow path seal 300 described above but a split base 390. The split base 390 may be completely separated into the form of two distinct halves, a first half 400 and a second half 410, so as to reduce the stress thereabout. The halves 400, 410 then may be connected as desired. The first arm 110 thus may be formed with the first half 400 and the second arm 120 may be formed with the second half 410. Other components and other configurations also may be used herein.

The near flow path seals 100, 200, 300 described herein thus provide flexible arms 110, 120. The axially flexible arms 110, 120 may tolerate gross axial deflections without inducing large alternating stresses due to rotor gravity sag loading and the like. The arms 110, 120 may be axially flexible with correspondingly low axial spring rates. As such, the near flow path seals 100, 200, 300 may result in a reduced risk of slippage at the bucket interfaces as well as associated fretting-wear failure. In other words, contact stresses may be reduced so as to improve the durability of the bucket interface. Lower alternating stresses also may increase the margin of safety of high cycle fatigue failure and the like. The near flow path seals 100, 200, 300 thus may require relatively less mass. The near flow path seals 100, 200, 300 described herein thus provide adequate sealing and improved overall durability with little to no added component costs.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A near flow path seal for a gas turbine, comprising:

a base configured to be positioned between a first bucket of a first turbine stage and a second bucket of a second turbine stage;

a pair of arms attached to a radially outer end of the base and extending from the base in substantially opposite directions, wherein the first arm is configured to be spaced apart from the first bucket at shutdown of the gas turbine and to deflect radially outward into contact with the first bucket for sealing thereabout during operation of the gas turbine, and wherein the second arm is configured to be spaced apart from the second bucket at shutdown of the gas turbine and to deflect radially outward into contact with the second bucket for sealing thereabout during operation of the gas turbine; and a curved indentation positioned axially between the pair of arms and extending radially inward toward the base such that the arms are axially flexible with respect to the base;

wherein the near flow path seal is circumferentially segmented about an axis thereof.

2. The near flow path seal of claim 1, wherein radially inner surfaces of the first arm and the second arm are curved in a concave manner to define a gull wing shape extending from the base.

3. The near flow path seal of claim 2, wherein the first arm is longer than the second arm in a direction of the axis of the near flow path seal.

4. The near flow path seal of claim 2, wherein the first arm is thicker than the second arm in a direction transverse to the axis of the near flow path seal.

5. The near flow path seal of claim 2, wherein the first arm and the second arm are angled with respect to the base, and wherein the first arm extends further away from the axis of the near flow path seal than the second arm.

6. The near flow path seal of claim 1, wherein the first arm and the second arm each define a cylindrical shape extending from the base.

7. The near flow path seal of claim 6, wherein the first arm is longer than the second arm in a direction of the axis of the near flow path seal.

8. The near flow path seal of claim 6, wherein the first arm is thicker than the second arm in a direction transverse to the axis of the near flow path seal.

9. The near flow path seal of claim 6, wherein the first arm and the second arm are parallel to one another, and wherein the first arm extends further away from the axis of the near flow path seal than the second arm.

10. The near flow path seal of claim 1, wherein the first arm and the second arm define a fork like shape extending from the base.

11. The near flow path seal of claim 10, wherein the first arm is longer than the second arm in a direction of the axis of the near flow path seal.

12. The near flow path seal of claim 10, wherein the first arm and the second arm are angled with respect to the base, and wherein the first arm extends further away from the axis of the near flow path seal than the second arm.

13. The near flow path seal of claim 10, wherein the first arm comprises a first fork arm and wherein the second arm comprises a second fork arm.

14. The near flow path seal of claim 10, wherein the curved indentation extends into the base such that the base comprises a separated base, wherein the curved indentation comprises a neck and a semi-circular joint, and wherein a diameter of the semi-circular joint is greater than a width of the neck.

15. The near flow path seal of claim 10, wherein the base comprises a split base comprising a first half and a second half formed separately and positioned adjacent one another, wherein the first arm extends from the first half, and wherein the second arm extends from the second half.

16. A near flow path seal for a gas turbine, comprising:

a separated base configured to be positioned between a first bucket of a first turbine stage and a second bucket of a second turbine stage;

a pair of arms attached to a radially outer end of the base and extending from the separated base in substantially opposite directions, wherein the first arm is configured to be spaced apart from the first bucket at shutdown of the gas turbine and to deflect radially outward into contact with the first bucket for sealing thereabout during operation of the gas turbine, wherein the second arm is configured to be spaced apart from the second bucket at shutdown of the gas turbine and to deflect radially outward into contact with the second bucket for sealing thereabout during operation of the gas turbine, and wherein the first arm and the second arm define a fork like shape extending from the base; and a curved indentation positioned axially between the pair of arms and extending radially inward into the base such that the arms are axially flexible with respect to the base;

wherein the near flow path seal is circumferentially segmented about an axis thereof.

17. The near flow path seal of claim 16, wherein the first arm is longer than the second arm in a direction of the axis of the near flow path seal.

18. The near flow path seal of claim 16, wherein the first arm and the second arm are angled with respect to the base, and wherein the first arm extends further away from the axis of the near flow path seal than the second arm.

19. The near flow path seal of claim 16, wherein the curved indentation comprises a neck and a semi-circular joint defined within the base, and wherein a diameter of the semi-circular joint is greater than a width of the neck.

20. A near flow path seal for a gas turbine, comprising:

a base configured to be positioned between a first bucket of a first turbine stage and a second bucket of a second turbine stage;

a pair of arms attached to a radially outer end of the base and extending from the base in substantially opposite directions, wherein the first arm is configured to be spaced apart from the first bucket at shutdown of the gas turbine and to deflect radially outward into contact with the first bucket for sealing thereabout during operation of the gas turbine, wherein the second arm is configured to be spaced apart from the second bucket at shutdown of the gas turbine and to deflect radially outward into contact with the second bucket for sealing thereabout during operation of the gas turbine, wherein the first arm and the second arm are parallel to one another, and wherein the first arm extends further away from an axis of the near flow path seal than the second arm; and a curved indentation positioned axially between the pair of arms and extending radially inward toward the base such that the arms are axially flexible with respect to the base;

wherein the near flow path seal is circumferentially segmented about the axis thereof.

* * * * *